United States Patent [19]

Jutte et al.

[11] 4,112,696

[45] Sep. 12, 1978

[54] DRIVE SHIELD

[76] Inventors: Hans Jutte, Kamphecke 13; Helmut Weber, Spannerweg 16, both of 4600 Dortmund, Fed. Rep. of Germany

[21] Appl. No.: 790,813

[22] Filed: Apr. 25, 1977

[30] Foreign Application Priority Data

Apr. 23, 1976 [DE] Fed. Rep. of Germany ..... 2617782

[51] Int. Cl.[2] ..... E01G 3/02

[52] U.S. Cl. ..... 405/145

[58] Field of Search ..... 61/85, 84, 45

[56] References Cited

U.S. PATENT DOCUMENTS 1,948,707 2/1934 Gilman ..... 61/85

3,306,055 2/1967 Tabor ..... 61/85

3,950,956 4/1976 Lobbe ..... 61/85

FOREIGN PATENT DOCUMENTS 1,236,548 3/1967 Fed. Rep. of Germany ..... 61/85

*Primary Examiner*—Jacob Shapiro

*Attorney, Agent, or Firm*—Lowe, King, Price & Markva

[57] ABSTRACT

A drive shield for use in tunnelling operations includes a generally cylindrical cutting edge supported by a frame. A knife shield is telescoped together with the cutting edge, the knife shield having a plurality of elongate members (or planks). Each of the planks is extensible relative to the cutting edge in the direction of tunnel advance. In use, all the planks are advanced relative to the cutting edge which is then advanced in a follow-up sequence.

15 Claims, 1 Drawing Figure

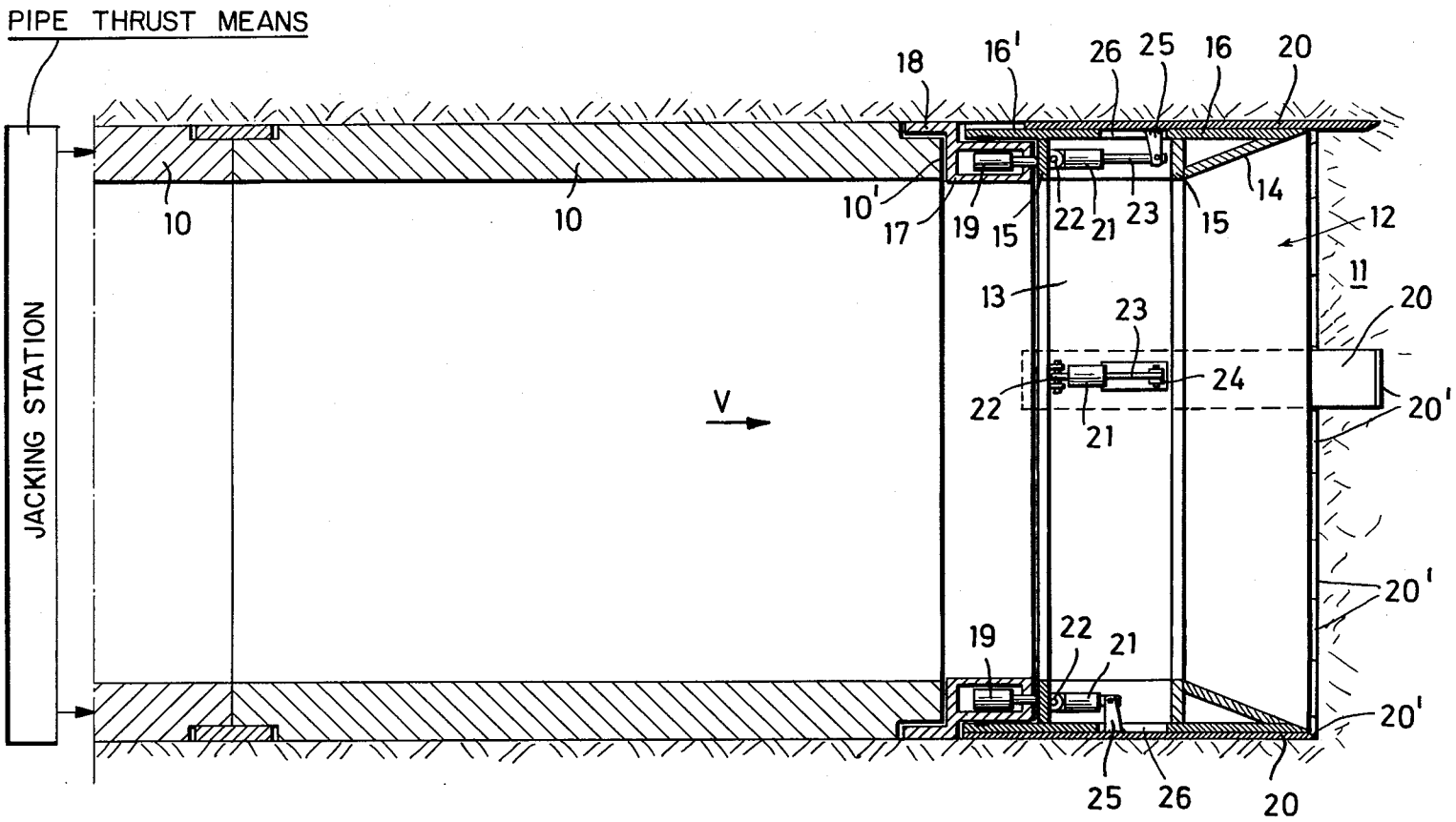
PIPE THRUST MEANS
JACKING STATION
V
10
10'
11
12
13
14
15
16
16'
17
18
19
20
20'
21
22
23
24
25
26

DRIVE SHIELD

BACKGROUND OF THE INVENTION

This invention relates to a drive shield for use in a tunnelling operation, and in particular to a drive shield for use in pipe laying. The term "tunnel" or "tunnels" used throughout this specification is intended to include galleries, trenches, adits and the like elongated excavations.

In a known pipe-laying operation, which is particularly useful for laying pipes such as sewers, the pipe sections are thrust-jacked, from the rear of the pipe, along a tunnel by means of a hydraulic jacking station. A drive shield having a wedge-shaped cutting edge is used, to excavate the tunnel, at the front of the pipe, in conjunction with a cutter/loader contained therein. When laying long pipes, it may be necessary to provide intermediate jacking stations along the pipe's length. This drive shield is provided with a thrust ring, which abuts the front end of the pipe, and with hydraulic advance rams interposed between the thrust ring and the drive shield for advancing the drive shield. Not only do these hydraulic advance rams constitute the means for advancing the drive shield relative to the laid pipe, but they also provide a certain degree of steering control to this advance movement.

The main disadvantage of this known drive shield is that, owing to the extraordinarily high jacking forces, pear-shaped pressure zones are formed in the region in front of the cutting edge. In the event of a sudden pressure release, the ground in these regions tends to collapse and fill up the interior of the drive shield. Another disadvantage is that, if the cutting edge hits an obstacle such as rock, the drive shield may be deflected and forced to advance in the wrong direction.

SUMMARY OF THE INVENTION

The present invention provides a drive shield for use in a tunnelling operation, the drive shield comprising a generally cylindrical cutting edge supported by a frame, and a generally cylindrical knife shield having a plurality of elongate members each of which is extensible relative to the cutting edge in the direction of tunnel advance, wherein the knife shield and the cutting edge are telescoped together.

Although tunnel drive shields usually have a circular cross-section, it will be appreciated that the cutting edge and the knife shield could have other cross-sectional forms.

Preferably, a generally cylindrical cutting shield constitutes both the frame and the cutting edge, and the knife shield surrounds the cutting edge.

Advantageously, each elongate member is provided with a respective device for extending that elongate member relative to the cutting edge. Preferably, each extending device is constituted by a hydraulic ram which acts between the frame and a respective elongate member. In this case, the hydraulic rams may be arranged within the cutting shield, and each hydraulic ram may be connected to the corresponding elongate member by means of a respective coupling element which extends through a respective aperture in the cutting shield.

Preferably, the cutting shield is provided internally with a pair of axially spaced, radially-extending webs, and the hydraulic rams are postioned between the webs.

Advantageously, the elongate members each have a length substantially equal to the length of the cutting shield.

Preferably, the cutting edge is movable in the direction of tunnel advance by hydraulic advance ram means associated with the frame.

The invention also provides apparatus for laying a pipe line comprising a drive shield for excavating a tunnel, and means for introducing pipe sections into the excavated tunnel, the drive shield being as defined above.

Advantageously, the cutting shield has a smaller cross-sectional area than the pipe being layed, and the knife shield elongate members slidably engage the outer peripheral surface of the cutting shield.

Preferably, the rear end of the cutting shield overlaps a thrust ring which, in use, is supported on the adjacent end of the laid pipe, and wherein the hydraulic advance ram means is arranged between the thrust ring and the cutting shield. This hydraulic advance ram means enables the direction of drive shield advance to be controlled.

This invention further provides a method of tunnelling using a drive shield which is constituted by a generally cylindrical cutting edge supported by a frame, and a generally cylindrical knife shield telescoped with the cutting edge. The method comprises the steps of advancing all the elongate members of the knife shield relative to the cutting edge and then advancing the cutting edge and frame.

The advantages obtained by the invention are considerable. The elongate members can be advanced singly, in groups or also jointly relative to the cutting edge thus, any pressure formation in front of the cutting edge can be largely prevented or at least be reduced to such an extent that undesired collapsing of the working face and filling up of the inside space of the drive shield be effectively prevented. Moreover, it is possible to simplify and improve the steering of the cutting edge considerably with this shield, because unilateral loading of the cutting edge can be prevented. Thus, if the advance of any individual elongate member meets with any unusual resistance, for example a rock inclusion in the ground, a pressure-relief valve or other type control and/or indicating instrument associated with that member will report this to a control station. The extent of the obstacle can then be determined by extending the adjacent elongate members. It is possible, therefore, to take timely measures with a view to removing the obstacle before the cutting edge has been advanced and so there will be no diversion from its desired advance direction. It is also advantageous that, with extended elongate members, the cutting edge is pressed into a space which is enclosed by the elongate members, so that the force required to advance the cutting edge is reduced, which in turn leads to a reduction of the cutting edge friction.

BRIEF DESCRIPTION OF THE DRAWING

Pipe laying apparatus including a drive shield constructed in accordance with the invention will now be described, by way of example, with reference to the accompanying drawing, the single FIGURE of which is a longitudinal cross-section through the drive shield and the front end of a laid pipe.

DESCRIPTION OF PREFERRED EMBODIMENT

Referring to the drawing, the pipe-line which consists of individual concrete pipe sections 10 is thrust-jacked into a tunnel by means of a jacking station, which is usually arranged in an end excavation or a shaft. Particularly in cases where the pipe-line is very long, intermediate jacking stations (not shown) may be provided so that the pipe-line can be jacked in stages in the direction of the arrow V. As soon as the pipe-line has been jacked by approximately the length of one-pipe section 10, a new pipe section is lowered into the end excavation (or shaft) and added to the rear of the pipe line, whereupon the extended pipe-line is again thrust-jacked in the direction V. This method of thrust-jacking is well known and so requires no further explanations.

The tunnel is excavated by means of a drive shield 12 located forwardly of the front of the pipe-line in the region of a working face 11. The drive shield 12 includes a cylindrical cutting shield 13 having a cylindrical jacket 16 and a wedge-shaped cutting edge 14. A pair of radially-extending webs 15 are welded to the cylindrical jacket 16 to stiffen the cutting shield 13. A rear extension 16' of the jacket 16 overlaps a thrust ring 17 which abuts the front face 10' of the front pipe section 10. The thrust ring 17 is constituted by a box section provided with an annular collar 18 which projects into an annular recess formed in the face 10' of the pipe section 10. A plurality of hydraulic advance rams 19 are arranged between the thrust ring 17 and the cutting shield 13, these rams being used for advancing the cutting shield. A certain directional control of the cutting shield advance is possible using these rams 19.

The cutting shield 13 is surrounded by a knife shield constituted by a plurality of elongate planks 20 which are arranged in a parallel side-by-side relationship so as to form an outer jacket for the cutting shield. Each plank 20 is provided with a separate hydraulic ram 21, the cylinder of which is connected to the rear web 15 by means of a bracket 22. The piston rod 23 of ram 21 is connected to plank 20 itself via a bracket 25 which passes through a slot 26 in jacket 16 of cutting shield 13. The rams 21 are positioned, for protection, between the two webs 15. It will be understood that the excavation of the working face 11 could be supplemented by means of a cutter/loader (not shown) positioned within the drive shield 12.

The length of the planks 20 substantially equals the length of the cutting shield 13 including its rear extension 16'. The external diameter of the jacket 16 of the cutting shield 13 is smaller than that of the pipe sections 10 by approximately the thickness of the planks 20.

In use, the planks 20 are advanced, either singly or in groups, in the direction V by pressurizing the rams 21. The drawing shows two planks 20 in the advanced position and the rest of the planks in the retracted position with their front cutting edges 20' approximately level with the cutting edge 14 of the cutting shield 13. Once all the planks 20 have been advanced, the cutting shield 13 can be advanced by the rams 19. Rams 21 are depressurized during the advance of cutting shield 13 so that planks 20 are not carried along with the cutting shield. A new pipe section 10 can then be added at the rear of the pipe-line which can then be jacked forward and the whole operation repeated.

By advancing the planks 20 prior to the advance of the cutting shield 13, it is possible to prevent the formation of large pressure zones in front of the cutting shield. Thus, there is no danger of a sudden pressure release leading to a collapse of the material of the working face 11 and the filling up of the drive shield 12. Moreover, by extending the planks 20 singly or in small groups, it is possible to locate an obstacle such as a rock lying in the path of the cutting shield 13. This means that the obstacle can be removed prior to the advance of the cutting shield 13 and so there is no danger of the cutting shield being blocked or of it being deviated from the desired direction of the advance.

We claim:

1. A drive shield for use in a tunnelling operation, the drive shield comprising:

(a) a generally cylindrical cutting shield having a cutting edge supported by a frame, (b) a generally cylindrical knife shield surrounding the cutting shield, (c) said knife shield having a plurality of elongate members each of which is extensible relative to the cutting edge in the direction of tunnel advance, wherein the knife shield and the cutting edge are telescoped together, (d) each elongate member is provided with a respective device for extending that elongate member relative to the cutting shield, (e) each said extending device is constituted by a hydraulic ram which acts between the cutting shield and a respective elongate member, (f) said hydraulic rams are arranged within the cutting shield, and (g) a respective coupling element connects each hydraulic ram to the corresponding elongate member, (h) each respective coupling element extends through a respective aperture in the cutting shield.

2. A drive shield according to claim 1, wherein the cutting shield is provided internally with a pair of axially spaced, radially-extending webs.

3. A drive shield according to claim 2, wherein the hydraulic rams are positioned between the webs.

4. A drive shield for use in a tunneling operation, the drive shield comprising:

(a) a generally cylindrical cutting shield having a cutting edge, (b) a generally cylindrical knife shield surrounding the cutting edge and having a plurality of elongate members which are extensible with respect to the cutting edge, (c) drive means for extending the elongate members in the direction of tunnel advance, (d) said drive means being disposed within the cutting shield, and (e) coupling means which extend through apertures in the cutting shield to connect the drive means to the elongate members.

5. A drive shield according to claim 4, wherein said drive means comprises hydraulic rams, and each elongate member is provided with a respective hydraulic ram for extending that elongate member relative to the cutting shield.

6. A drive shield according to claim 4, wherein the cutting shield is provided internally with a pair of axially spaced, radially-extending webs.

7. A drive shield according to claim 6, wherein said drive means comprises hydraulic rams positioned between said webs.

8. A drive shield according to claim 4, wherein said elongate members each have a length substantially equal to the length of the cutting shield.

9. A drive shield according to claim 4, wherein said drive means comprise hydraulic advance ram means for moving the cutting shield in the direction of tunnel advance.

10. Apparatus for laying a pipeline comprising:
(a) a drive shield for excavating a tunnel,
(b) means for introducing pipe sections into the excavated tunnel,
(c) said drive shield comprising a generally cylindrical cutting shield provided with a cutting edge, and a generally cylindrical knife shield surrounding the cutting shield,
(d) said knife shield having a plurality of elongated members which are extensible, by hydraulic rams, relative to the cutting shield in the direction of tunnel advance,
(e) the hydraulic rams being disposed within the cutting shield and connected to the elongate members by means of coupling elements which extend through apertures in the cutting shield.

11. Apparatus according to claim 10, wherein
the cutting shield has a smaller cross-section area than the pipe being laid, and
the knife shield elongate members slidably engage the outer peripheral surface of the cutting shield.

12. Apparatus according to claim 10, wherein
said drive shield includes a thrust ring which, in use, is supported on the adjacent end of the laid pipe,
said cutting shield has a rear end portion that overlaps the thrust ring, and
said drive means includes hydraulic advance ram means arranged between the thrust ring and the cutting shield, whereby the cutting shield is movable in the direction of tunnel advance.

13. Apparatus according to claim 10, wherein
said means for introducing pipe sections into the tunnel is situated at a remote position from the drive shield, and
thrust means are provided for thrust jacking the entire pipe in the direction of tunnel advance.

14. Apparatus according to claim 13, wherein
said thrust means is situated at said remote position and acts on the last laid pipe section to thrust the entire pipe forward.

15. Apparatus for laying a pipeline comprising:
(a) a drive shield for excavating a tunnel,
(b) means for introducing pipe sections into the excavated tunnel remote from the drive shield, and
(c) thrust means for thrust jacking the entire pipe in the direction of tunnel advance,
(d) said thrust means being located at said remote position and acting on the last laid pipe section to thrust the entire pipe forward,
(e) the drive shield comprising a generally cylindrical cutting shield provided with a cutting edge, and a generally cylindrical knife shield surrounding the cutting shield,
(f) said knife shield having a plurality of elongate members which are extensible by hydraulic rams relative to the cutting shield in the direction of tunnel advance, and
(g) hydraulic control rams for controlling the direction of advance of the drive shield,
(h) said hydraulic rams being arranged within the cutting shield and connected to the elongate members by means of coupling elements which extend through apertures in the cutting shield.

* * * * *

UNITED STATES PATENT OFFICE

CERTIFICATE OF CORRECTION

Patent No. 4,112,696 Dated September 12, 1978

Inventor(s) HANS JUTTE and HELMUT WEBER

It is certified that error appears in the above-identified patent and that said Letters Patent are hereby corrected as shown below:

On the title page, insert

--Assignee: Gewerkschaft Eisenhutte Westfalia
Lunen, Germany --.

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*